US012053134B2

(12) United States Patent
DeBoer et al.

(10) Patent No.: US 12,053,134 B2
(45) Date of Patent: Aug. 6, 2024

(54) DISHWASHER

(71) Applicant: WHIRLPOOL CORPORATION, Benton Harbor, MI (US)

(72) Inventors: John M. DeBoer, Stevensville, MI (US); Arkadiusz Teclaw, Wroclaw (PL); Russikant Behera, Dhenkanal (IN)

(73) Assignee: Whirlpool Corporation, Benton Harbor, MI (US)

( * ) Notice: Subject to any disclaimer, the term of this patent is extended or adjusted under 35 U.S.C. 154(b) by 337 days.

(21) Appl. No.: 17/400,680

(22) Filed: Aug. 12, 2021

(65) Prior Publication Data

US 2023/0052306 A1 Feb. 16, 2023

(51) Int. Cl.
*A47L 15/42* (2006.01)

(52) U.S. Cl.
CPC ..... *A47L 15/4293* (2013.01); *A47L 15/421* (2013.01); *A47L 15/4257* (2013.01); *A47L 15/4274* (2013.01); *A47L 2401/10* (2013.01); *A47L 2501/36* (2013.01)

(58) Field of Classification Search
None
See application file for complete search history.

(56) References Cited

U.S. PATENT DOCUMENTS

| | | | |
|---|---|---|---|
| 2,826,658 A | 3/1958 | Jackson | |
| 8,262,807 B2 | 9/2012 | Son | |
| 9,683,731 B2 | 6/2017 | Kim et al. | |
| 2004/0066096 A1 | 4/2004 | Pearson et al. | |
| 2006/0081015 A1 | 4/2006 | Rizzetto et al. | |
| 2008/0134728 A1 | 6/2008 | Son | |
| 2013/0091904 A1 | 4/2013 | Kim et al. | |
| 2014/0124342 A1 | 5/2014 | Osvatic et al. | |
| 2016/0051123 A1* | 2/2016 | Gleixner | A47L 15/4257 134/113 |
| 2019/0046003 A1* | 2/2019 | Ryan | H01H 21/22 |
| 2019/0046303 A1 | 2/2019 | Ryan | |
| 2020/0405121 A1 | 12/2020 | Park et al. | |

FOREIGN PATENT DOCUMENTS

| | | | |
|---|---|---|---|
| CA | 2231708 | | 10/1998 |
| DE | 19651821 | C2 | 4/2003 |
| DE | 102010042775 | A | 4/2012 |
| EP | 2460454 | A2 | 6/2012 |
| EP | 3149235 | B1 | 6/2018 |
| WO | 2016/151070 | A1 | 9/2016 |
| WO | 2018/065202 | A1 | 4/2018 |

OTHER PUBLICATIONS

European Extended Search Report corresponding to EP 22189808.3 mailed Jan. 5, 2023.

* cited by examiner

*Primary Examiner* — Levon J Shahinian
(74) *Attorney, Agent, or Firm* — McGarry Bair PC

(57) ABSTRACT

A dishwasher door assembly can include a door with an exterior surface bounding an interior space, a controller, a light source electronically coupled to the controller and positioned within the interior space, and an optical waveguide coupled to the door and configured to direct emitted light from the light source out of the interior space.

20 Claims, 7 Drawing Sheets

DISHWASHER

BACKGROUND

Contemporary automatic dishwashers for use in a typical household include a tub that can have an open front and at least partially defines a treating chamber into which items, such as kitchenware, glassware, and the like, can be placed to undergo a washing operation. At least one rack or basket for supporting soiled dishes can be provided within the tub. A spraying system with multiple sprayers can be provided for recirculating liquid throughout the tub to remove soils from the dishes. A door assembly is provided to seal the treating chamber and can include a user interface for selecting, modifying, or otherwise controlling a cycle of operation.

BRIEF DESCRIPTION

In one aspect, the disclosure relates to a dishwasher door assembly including a door with an exterior surface bounding an interior space, a controller, a light source electronically coupled to the controller and positioned within the interior space, an optical waveguide coupled to the door and configured to direct emitted light from the light source out of the interior space, and a fluid channel located at least in the optical waveguide and forming a bypass flow path fluidly isolated from the controller.

In another aspect, the disclosure relates to a dishwasher door assembly including a door with an exterior surface bounding an interior space, a controller positioned within the interior space and having a switch, with the switch inaccessible from the exterior of the door and actuatable by movement in a first direction, and an actuator, accessible from the exterior of the door, and moveable in a second direction different from the first direction, with the actuator mechanically coupled to the switch such that movement of the actuator in the second direction actuates the switch in the first direction.

DETAILED DESCRIPTION

Figure 1:
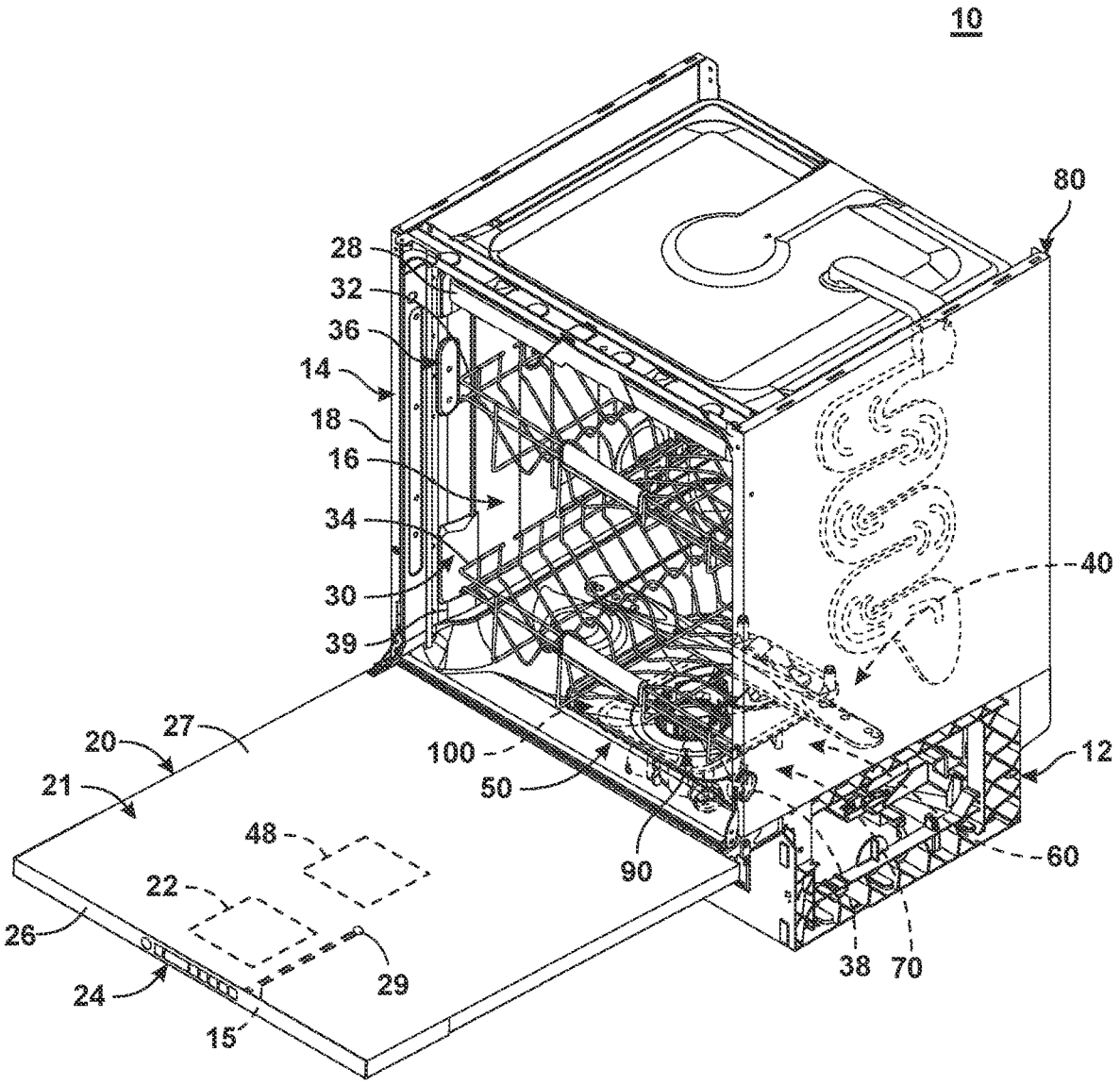
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The door assembly 20 can include a door 21 with an exterior surface 23 bounding an interior space 25. The exterior surface 23 can include a top edge 26 and an inner surface 27. The inner surface 27 can be configured to confront the open face 18 and at least partially define the treating chamber 16, such as when the door assembly 20 is in a closed position.

A fluid channel 15 can be provided in the door assembly 20. In some examples, the fluid channel 15 can extend into the interior space 25 of the door 21. In some examples, the fluid channel 15 can include an outlet 29 on the exterior surface 23 of the door 21. In the example of FIG. 1 the outlet 29 is illustrated on the inner surface 27 of the door 21, though the disclosure is not so limited. The outlet 29 can be provided anywhere within the door assembly 20.

A controller 22 and a user interface 24 can be provided in the dishwasher 10. The controller 22 can be operably coupled with various components of the dishwasher 10 to implement a cycle of operation. In one example, the controller 22 can be located within the interior space 25 of the door 21. In another example, the controller 22 can be located somewhere within the chassis. In one example, the user interface 24 can be provided in the door assembly 20. The user interface 24 can be operably coupled with the controller 22 for transmitting user-selected inputs and communicating information to the user. The user interface 24 can include operational controls such as dials, lights, switches, and displays enabling a user to input commands, such as a cycle of operation, to the controller 22 and receive information. In one example, the user interface 24 can be provided in the form of a console coupled to the door 21. In another example, the user interface 24 can be integrated with the door 21 to form part of a door housing of the door 21.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slideably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
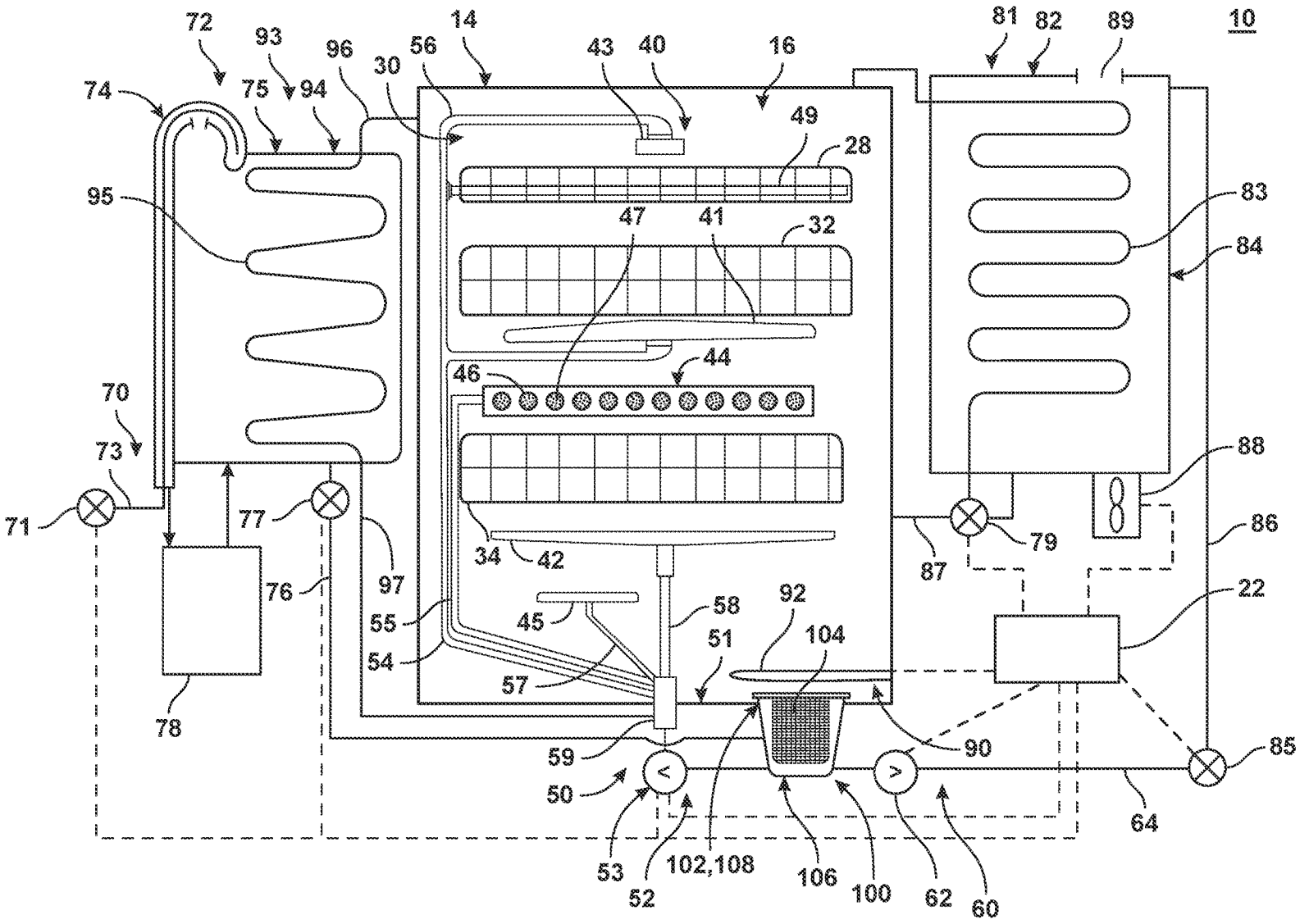
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 49 can be located at least in part below a portion of the third level rack 28. The sprayer 49 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 28-44 to the recirculation pump 53. A recirculation valve 59 can selectively fluidly couple each of the conduits 54-58 to the recirculation pump 53. While each sprayer 28-44 is illustrated as having a corresponding dedicated supply conduit 54-58 one or more subsets, comprising multiple sprayers from the total group of sprayers 28-44, can be supplied by the same conduit, negating the need for a dedicated conduit for each sprayer. For example, a single conduit can supply the upper spray arm 41 and the third level sprayer 43. Another example is that the sprayer 49 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
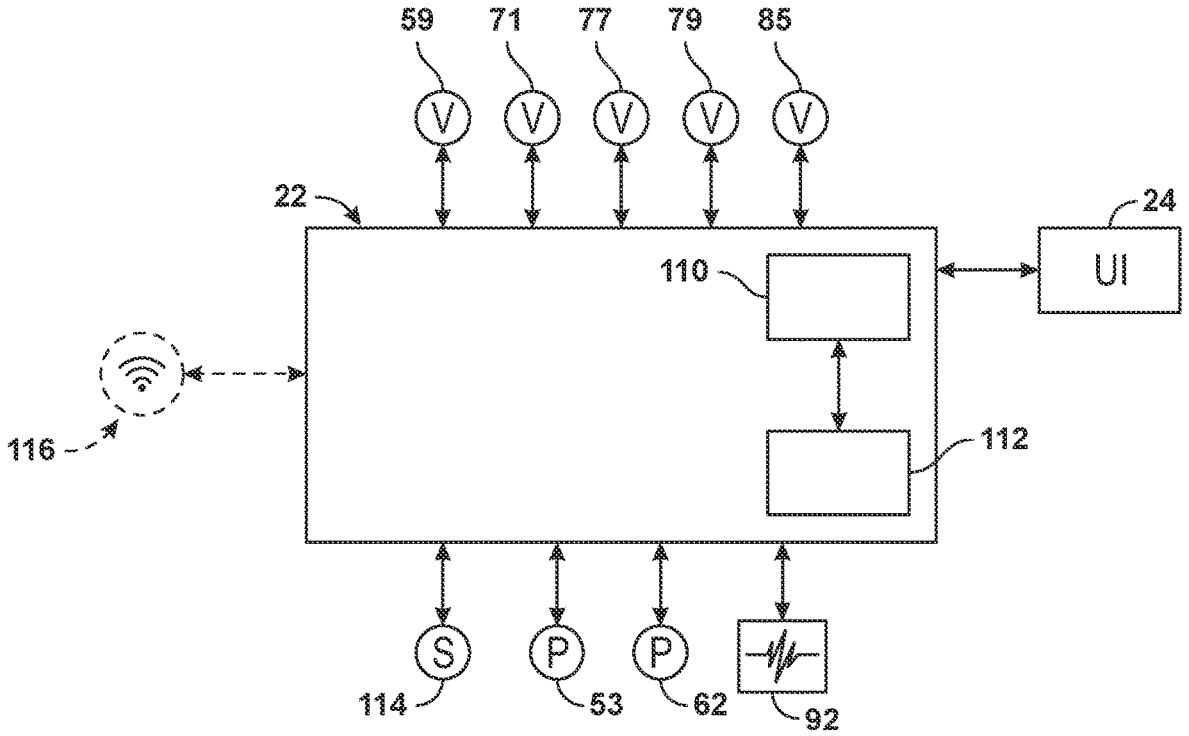
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
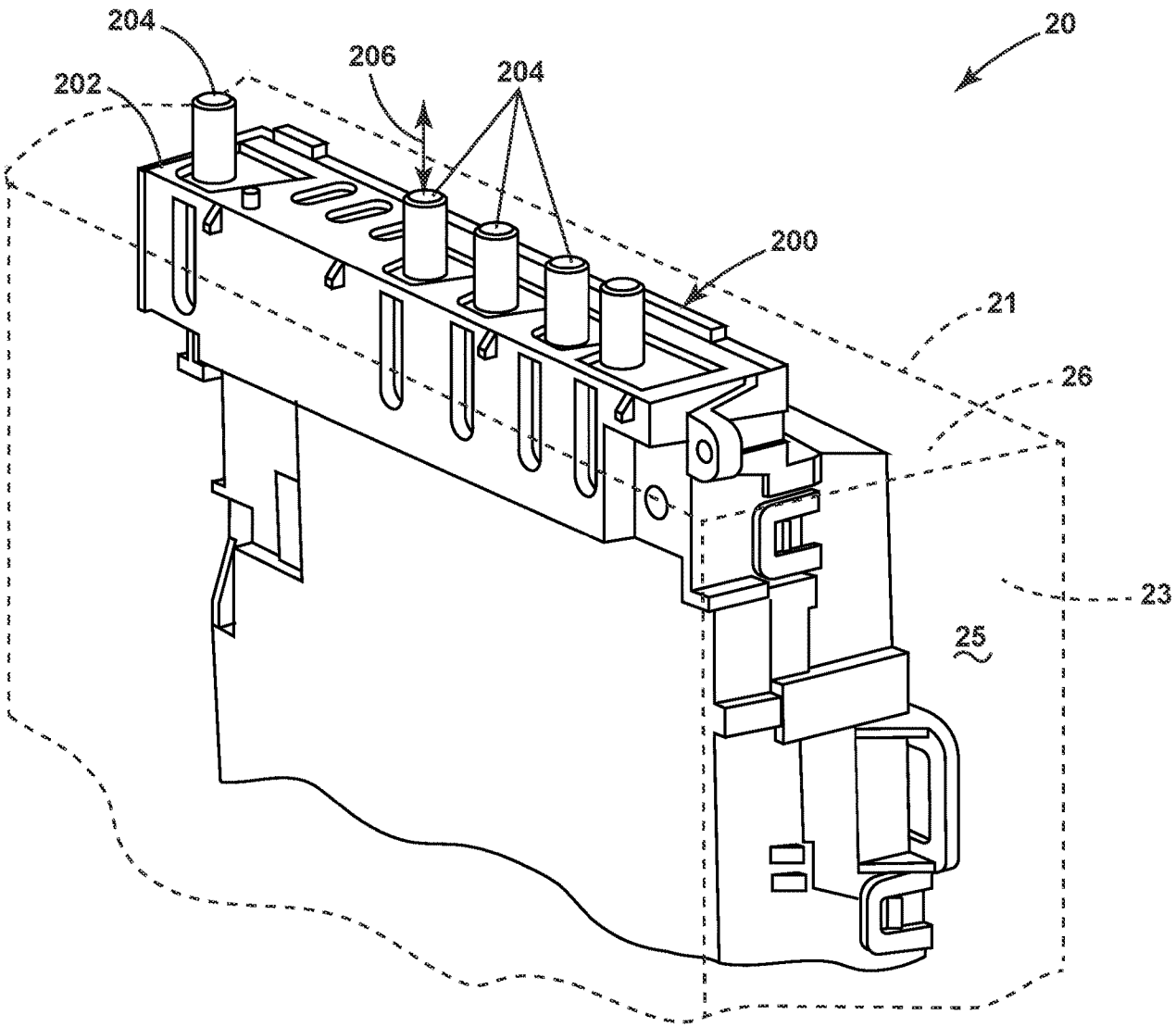
FIG. 4 is a perspective view of the door assembly of FIG. 1 in accordance with various aspects described herein.

Referring now to FIG. 4, one exemplary component 200 is illustrated that can be utilized in the dishwasher door assembly 20. The component 200 can include a housing 202 for carrying or supporting elements of the user interface 24 described above, including operational controls such as dials, lights, switches, or displays. The housing 202 can be positioned within the interior space 25 of the door 21. The door 21 is illustrated in in FIG. 4 with dashed line indicating the exterior surface 23.

One or more switches 204 can be included in the user interface 24 and carried by the housing 202. In the example of FIG. 4, five switches 204 are shown and any number of switches can be provided. At least one switch 204 can be in the form of an actuator that is movable or actuatable along a direction 206 as shown. For example, the switch 204 can be in the form of a push button 208. At least one switch 204 can be accessible from the exterior of the door 20. In one example, the switch 204 can extend outwardly from the door assembly 20 and be directly accessible by a user. In another example, an applique or top panel can be provided over the switch 204, whereby a user can exert force on the top panel for actuation of the switch 204. In another example, the switch 204 can extend from the top edge 26 of the door 21.

The controller 22 can be positioned within or carried by the housing 202. The switch 204 can be electronically coupled to the controller 22. At least one light source 212 can also be electronically coupled to the controller 22. In one example, the light source 212 can be integrated with the controller 22. In another example, the light source 212 can be positioned remotely from the controller 22 while still electronically coupled to the controller 22. The light source 212 can be positioned within or carried the housing 202. In this manner, either or both of the controller 22 or light source 212 can be positioned within the interior space 25 of the door 21.

Figure 5:
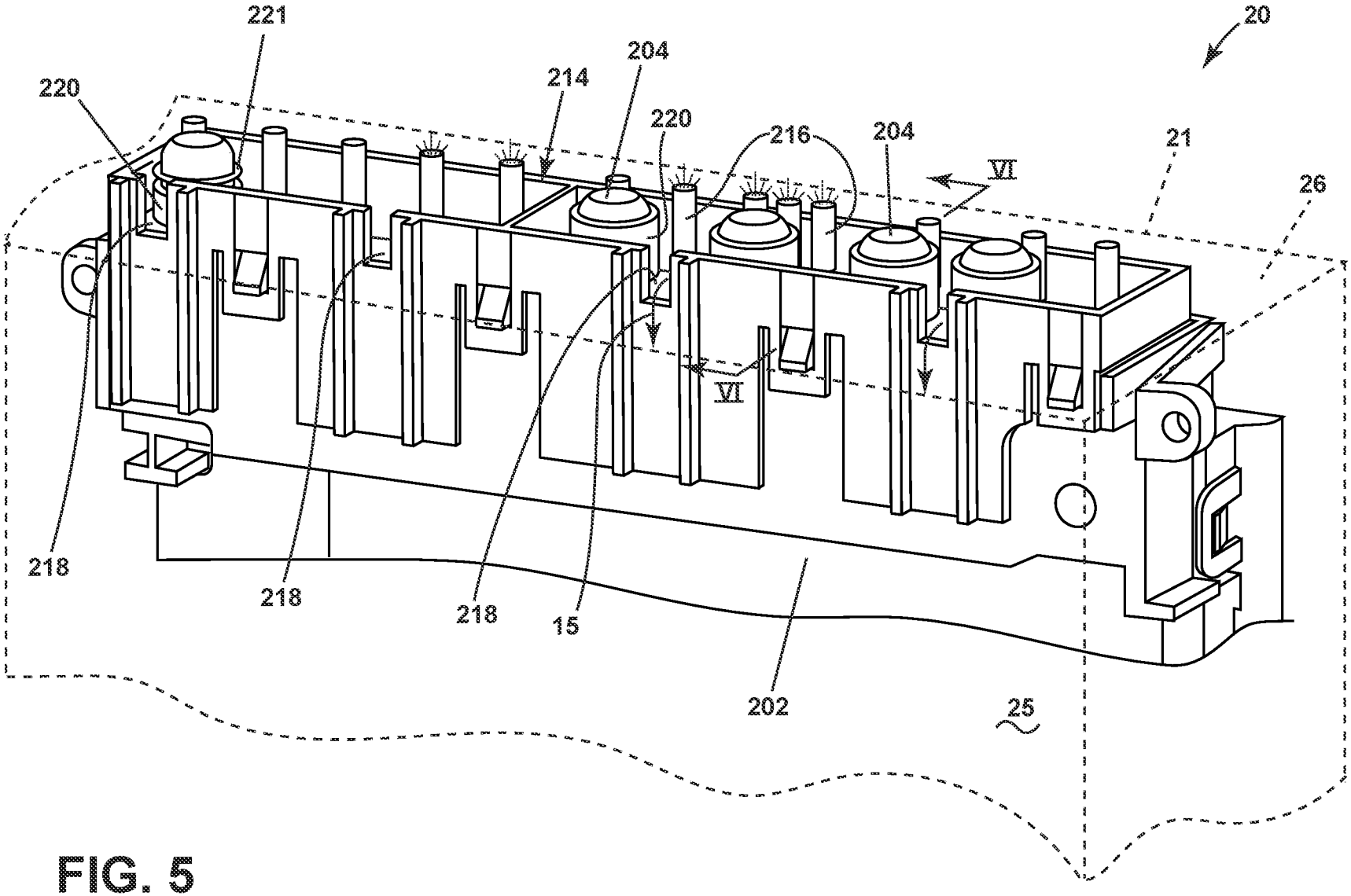
FIG. 5 is a perspective view of the door assembly of FIG. 4 including an optical waveguide in accordance with various aspects described herein.

Turning to FIG. 5, an optical waveguide 214 is illustrated that can be coupled to the door 21. More specifically, the optical waveguide 214 can be included with or coupled to the housing 202 of the user interface 24. In the example shown, the optical waveguide 214 is shown along the top edge 26 of the door 21 though this need not be the case. The optical waveguide 214 can form a light guide, a light pipe, or any suitable structure configured to direct emitted light therethrough. In the example shown, light pipes 216 are provided. In some examples, the entire optical waveguide 214 can be formed of a transparent or translucent material. In some examples the optical waveguide can be configured to direct emitted light out of the interior space 25 of the door 21. In some examples the optical waveguide 214 can form part of a housing of the door 21. In some examples the optical waveguide 214 can include a base surface 218 and a switch housing 220. In such a case, the switch housing 220 can extend from the base surface 218. The switch housing 220 can also at least partially surround at least one switch. In the example of FIG. 5, the switch housing 220 surrounds the switches 204 though this need not be the case. In some examples, the fluid channel 15 of the door assembly 20 can be located at least in the optical waveguide 214. In some examples, the fluid channel can be formed at least partially along the base surface 218 of the optical waveguide 214.

Additionally or alternatively, a seal 221 can be coupled to the switch 204. In one example, an elastomeric seal 221 can be coupled to a button stem 210 of the switch 204. In such a case, the switch housing 220 can be formed to expose more of the button stem 210 to provide for a travel distance when pressing the switch 204. The seal 221 can be configured to abut the switch housing 220 when the switch 204 is pressed. In this manner, the seal 221 can be configured to fluidly seal the switch housing 220. In some examples, the optical waveguide 214 can be formed without fluid channels and discrete seals 221 can be coupled to each switch 204. In some examples, the optical waveguide 214 can be formed having the fluid channels 15 without any seals in the component 200. In some examples, both seals 221 and fluid channels 15 can be provided with the component 200.

Figure 6:
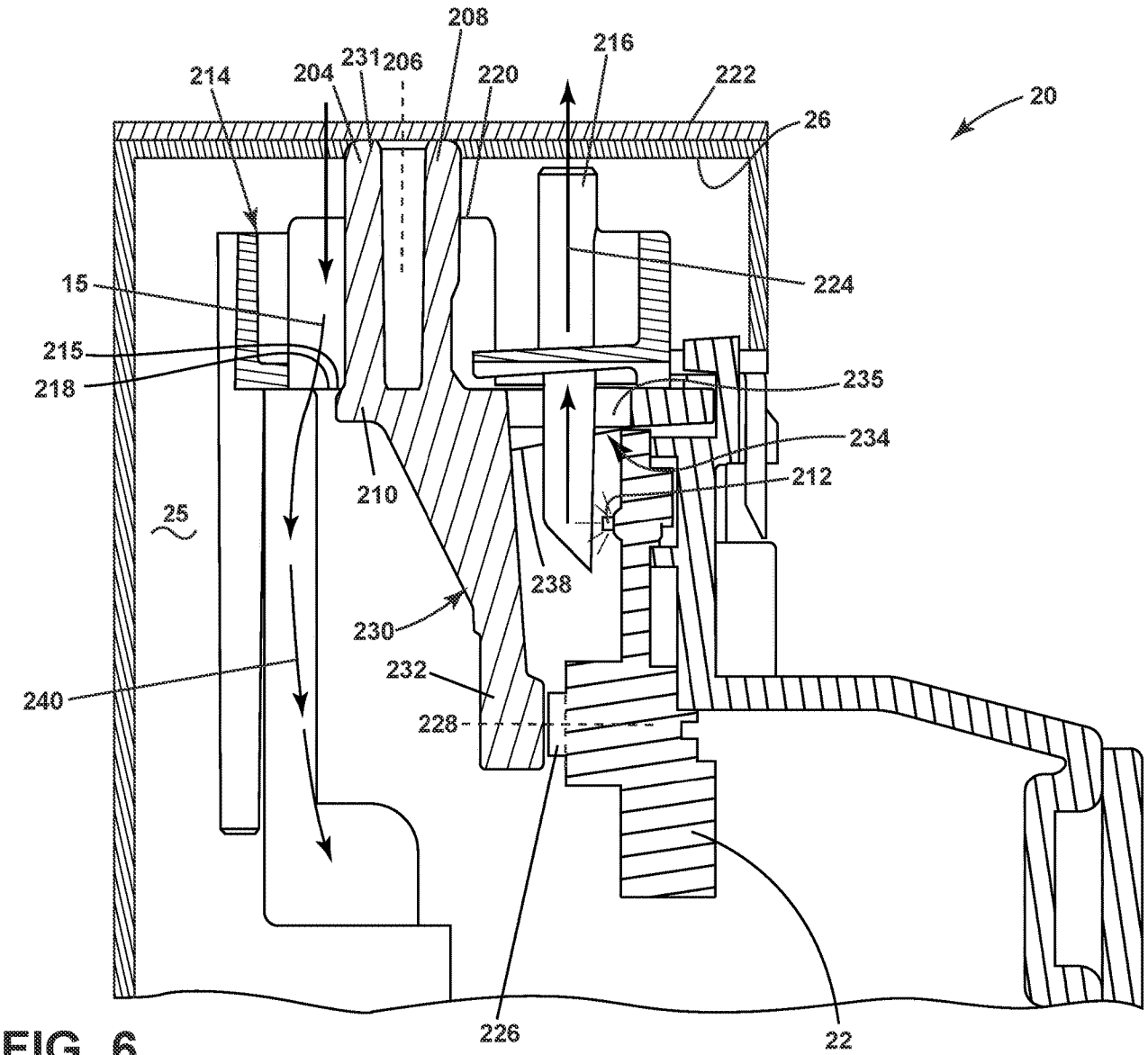
FIG. 6 is a side cross-sectional view of an upper portion of the door assembly of FIG. 4 along line VI-VI illustrating a user-selectable switch in a first position.

Referring now to FIG. 6, a cross-sectional view of the door assembly 20 is shown. Optionally, an outer panel 222 can be provided along the top edge 26 of the door 21. The outer panel 222 can form an applique for the door assembly 20. In some examples, the outer panel 222 can be configured to actuate the switch 204, whereby a force exerted on the outer panel 222 can be transmitted to the switch 204. The outer panel 222 can include a transparent or translucent material in some examples. The top edge 26 of the door 21 can also include a transparent or translucent material in some examples. In one exemplary implementation, the outer panel 222 can cover the switch 204. In another example, the switch 204 can extend fully through the outer panel 222. In still another example, the door 21 can include the switch 204 with no outer panel present.

The switch 204 can extend into the housing 202 as shown. In some examples, the switch 204 can include a push button with button stem 210 extending into the switch housing 220. In some examples, the switch 204 can include a pivotable injection-molded button. In one example, the switch 204 can have a unitary actuator body 230 extending from a first end 231 to a second end 232. The first end 231 can be accessible from the exterior of the door 21. The button stem 210 can form part of the actuator body 230. In some examples, the button stem 210 can be configured to form the second end 232. In some examples, the button stem 210 can be configured to abut the controller 22. In some examples, a pivotal coupling 234 can be provided between the actuator body 230 and the door 21. In some examples, the pivotal coupling 234 can be positioned adjacent the first end 231 of the actuator body 230. The actuator body 230 can include an arm 235 configured to rotate along a surface 238 of the housing 202.

In the example shown, the controller 22 is positioned within the housing 202 of the user interface 24 within the door 21. The light source 212 can also be provided in the door assembly 20. In the example shown the light source 212 is provided with the controller 22. The light pipe 216 extends into the housing 202 and at least partially confronts the light source 212. Emitted light from the light source 212 can be directed through the light pipe 216, as illustrated by arrows 224. In this manner, the optical waveguide can be configured to direct emitted light from the light source 212 out of the interior space 25 of the door 21.

In some examples, the controller 22 can include a printed circuit board (PCB) having a set of electrical components, including the light source 212. The controller 22 can also include a controller switch 226. The controller switch 226 can be inaccessible from the exterior of the door 21. The controller switch 226 can be actuatable by movement in a first direction 228. For example, the controller switch 226 can include a push button. The switch 204 can be in the form of an actuator movable in the direction 206 different from the first direction 228. The second end 232 of the switch 206 can confront the controller switch 226.

The fluid channel 15 is illustrated along the optical waveguide 214. The fluid channel 15 can also extend into the interior space 25 of the door 21. In some examples, the fluid channel 15 can be formed in the housing 202 of the component 200. In some examples, the fluid channel 15 can include an inlet 215 on the optical waveguide 214. It is contemplated that the fluid channel 15 can form a bypass flow path 240 fluidly isolated from the controller 22. For example, liquid may splash onto or otherwise encounter the outer panel 222 or top edge 26 of the door 21, such as through a gap in either or both of the outer panel 222 or top edge 26. Such liquid can be directed along the optical waveguide 214 along the bypass flow path 240 and away from the controller 22. In this manner the bypass flow path 240 can prevent undesirable contact with electronic components contained within the door assembly 20, such as the controller 22.

Figure 7:
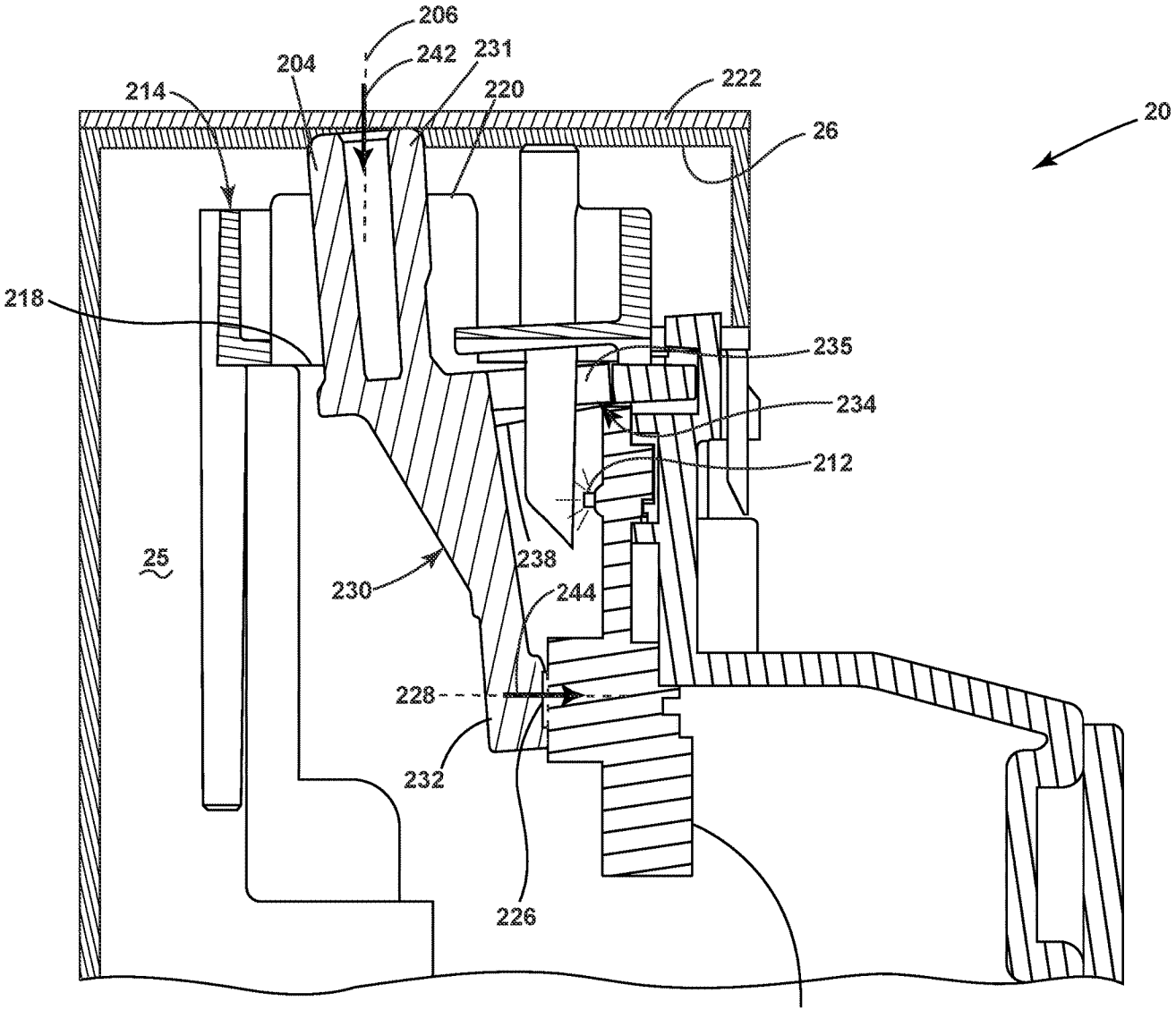
FIG. 7 is a side cross-sectional view similar to FIG. 6, but illustrating the user-selectable switch in a second position.

Turning to FIG. 7, the switch 204 is illustrated under application of an input force 242 on the first end 231. It is contemplated that the actuator body 230 of the switch 204 can pivot or rotate such that the input force 242 at the first end 231 can be redirected into a contact force 244 on the controller 22. More specifically, the contact force 244 can be applied by the second end 232 of the actuator body 230 at the controller switch 226. In an example where the controller switch 226 includes a push button, the second end 232 of the actuator body 230 can actuate the controller switch 226 to compress the push button mechanism. In this manner, the actuator body 230 can be mechanically coupled to the controller switch 226 such that movement of the actuator body 230 in a second direction, such as the direction 206, actuates the controller switch 226 in the first direction 228. In an example where the pivotal coupling 234 is provided, the input force 242 on the actuator body 230 along the first direction 228 can be rotatably redirected to the contact force 244 along the direction 206.

Aspects of the disclosure provide for a variety of benefits including a dishwasher door assembly with integrated user interface, light guide, actuator force redirecting, and fluid sealing of electronic components contained therein. The switches described herein provide for positioning a user interface on a space-limited region of a dishwasher door, such as the outer or top edge, while utilizing a controller having actuators facing a different region of the dishwasher door. In one example, a single controller type having horizontally-actuatable switches can be utilized in both a dishwasher door with a front-facing user interface (e.g. with front-facing buttons) as well as a dishwasher door with a user interface along the top edge of the door (e.g. with force-redirecting buttons). Such an arrangement can reduce assembly costs, improve the switch functionality, or increase part lifetimes as compared to traditional door arrangements with switches located remotely from internal controllers and connected by wires. The optical waveguide or light guide described herein can provide for fluid protection of electronic components, such as the controller, while also forming part of the user interface for directing emitted light out of the dishwasher door interior. Sealing elements can also be utilized in conjunction with the optical waveguide for fluid sealing or fluid protection of internal electronic components.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher door assembly, comprising:

a door with an exterior surface bounding an interior space;

a controller;

a light source electronically coupled to the controller and positioned within the interior space;

a switch electronically coupled to the controller and extending to the exterior surface;

an optical waveguide coupled to the door and configured to direct emitted light from the light source out of the interior space; and a fluid channel located at least in the optical waveguide and forming a bypass flow path fluidly isolated from the controller.

2. The dishwasher door assembly of claim 1, wherein the fluid channel extends into the interior space of the door.

3. The dishwasher door assembly of claim 2, wherein the fluid channel comprises an inlet on the optical waveguide and an outlet on the exterior surface of the door.

4. The dishwasher door assembly of claim 3, wherein the controller is positioned within the interior space of the door.

5. The dishwasher door assembly of claim 1, wherein the optical waveguide comprises a switch housing extending from a base surface and at least partially surrounding the switch.

6. The dishwasher door assembly of claim 5, further comprising a seal coupled to the switch and configured to fluidly seal the switch housing.

7. The dishwasher door assembly of claim 5, wherein the switch comprises a push button with a button stem extending into the switch housing.

8. The dishwasher door assembly of claim 7, further comprising an elastomeric seal coupled to the button stem and configured to abut the switch housing when the switch is pressed.

9. The dishwasher door assembly of claim 7, wherein the button stem is configured to abut the controller and to redirect an input force on the push button into a contact force on the controller.

10. The dishwasher door assembly of claim 5, wherein the switch housing extends to the exterior surface of the door.

11. A dishwasher door assembly, comprising:

a door with an exterior surface bounding an interior space;

a controller positioned within the interior space and having a controller switch, with the controller switch inaccessible from the exterior of the door and actuatable by movement in a first direction;

an actuator, accessible from the exterior of the door, and moveable in a second direction different from the first direction, with the actuator mechanically coupled to the controller switch such that movement of the actuator in the second direction actuates the controller switch in the first direction; and an optical waveguide coupled to the door and comprising a switch housing at least partially surrounding the actuator.

12. The dishwasher door assembly of claim 11, further comprising a pivotal coupling between the actuator and the door, whereby an input force on the actuator along the first direction is rotatably redirected to a contact force along the second direction.

13. The dishwasher door assembly of claim 11, wherein the actuator comprises a unitary body extending from a first end to a second end, with the first end accessible from the exterior of the door and the second end confronting the controller switch.

14. The dishwasher door assembly of claim 13, further comprising a pivotal coupling between the actuator and the door.

15. The dishwasher door assembly of claim 14, wherein the pivotal coupling is positioned adjacent the first end of the body of the actuator.

16. The dishwasher door assembly of claim 11, wherein the actuator comprises a pivotable injection-molded button.

17. The dishwasher door assembly of claim 16, wherein the controller switch comprises a push button.

18. The dishwasher door assembly of claim 11, wherein the actuator extends through the optical waveguide.

19. The dishwasher door assembly of claim 11, wherein the actuator comprises a first end extending to a top edge of the door.

20. The dishwasher door assembly of claim 19, wherein the switch housing extends to the top edge of the door.

* * * * *